US005395118A

United States Patent [19]

Barrett

[11] Patent Number: 5,395,118

[45] Date of Patent: Mar. 7, 1995

[54] CROSSWORD GAME BOARD APPARATUS

[76] Inventor: Robert E. Barrett, 61 Ardmore Ave., Providence, R.I. 02908

[21] Appl. No.: 240,450

[22] Filed: May 10, 1994

[51] Int. Cl.[6] ..... A63F 3/00

[52] U.S. Cl. ..... 273/272; 273/299

[58] Field of Search ..... 273/272, 276, 285, 299; 434/172

[56] References Cited

U.S. PATENT DOCUMENTS

| | | | |
|---|---|---|---|
| 1,633,445 | 6/1927 | Gail et al. | 273/130 |
| 2,320,832 | 6/1943 | Schoenberg et al. | 273/130 |
| 3,565,439 | 2/1971 | Krouse et al. | 273/135 |
| 3,877,703 | 4/1975 | Pierce | 273/130 |
| 4,384,722 | 5/1983 | Higgins | 273/272 |
| 4,420,157 | 12/1983 | White et al. | 273/272 |
| 4,850,595 | 7/1989 | Sherman et al. | 273/272 |
| 5,058,896 | 10/1991 | Bez | 273/272 |
| 5,139,271 | 8/1992 | Bez | 273/272 |
| 5,230,515 | 7/1993 | Cohen | 273/261 |

*Primary Examiner*—Vincent Millin
*Assistant Examiner*—William M. Pierce
*Attorney, Agent, or Firm*—Barlow & Barlow, Ltd.

[57] ABSTRACT

A game board apparatus for use by two teams of players is provided. The game board apparatus includes a grid of equal sized squares. Two of the squares represent starting points for each of the teams, respectively. Further, two adjacent clusters of squares form reserved areas for each of the two teams, respectively, which permits only the team that owns the reserved area to start a word within the reserved area. A bonus bridge dividing line is positioned between the two reserved areas. Bridging the two arrays emanating from the respective starting points and forming a word which crosses the bonus bridge dividing line yields additional bonus points.

11 Claims, 5 Drawing Sheets

CROSSWORD GAME BOARD APPARATUS

BACKGROUND OF THE INVENTION

The present invention relates generally to games. More specifically, the present invention relates to a crossword game board apparatus that permits two teams of players to play against one another.

In the art of games, namely crossword board games, it has been well known to employ a grid of squares for receiving letters for the formation of conjoined words in crossword format. Typically, when a player forms a word, points are received in accordance with the size of the word and the letters used. After a player uses a number of letters to form a word on the board, the player draws from a letter supply to replace the letters used. Further, in prior art crossword board games, interaction between players is limited to the ability to form words based on another player's previously formed word on the board. As a result, the selection and replenishment of letters is completely random by virtue of the blind selection of new letters from a supply common to all players. Such random and blind drawing of new letters can be monotonous and uninteresting.

In addition, prior art crossword board games are not goal oriented or well suited to being played by players formed into teams. Simulated team play can be achieved in prior art games by simply totaling the score of players on the same team to generate a team score. However, the actual game play between team members is not actually interrelated. Other than the words actually placed on the game board, a player's play is substantially unaffected by another player's activity.

Due to the demand for a more interesting and challenging crossword game, a game board apparatus is desired which provides actual interrelated team play as well as additional playing goals specifically geared to team play. Therefore, it is further desirous for a player to be able to reduce the random nature of play while increasing the amount of skill required.

SUMMARY OF THE INVENTION

The present invention preserves the advantages of prior art crossword game board apparatuses. In addition, it provides new advantages not found in currently available game apparatuses, and overcomes many of the disadvantages of such currently available apparatuses.

The invention is generally directed to a novel and unique crossword board game apparatus with particular application in interrelated and challenging team play. The crossword board game apparatus of the present invention reduces the random nature of crossword board games while increasing the requirement for skill and teamwork.

The preferred embodiment of the present invention includes a board game apparatus for play by two teams of players. A plurality of planar playing pieces is provided. The letters are marked with a single letter of the alphabet or are left blank, denoting universal or wild card use. Each playing piece is assigned a scoring value, with an initial random allotment of an equal set of the playing pieces to each of the players. Further, a supply of additional playing pieces is provided for replacement of discarded or used letters.

The game board has a flat surface for receiving thereon the playing pieces in the form of words. The game board includes a grid of squares formed of intersecting lines to conform to the configuration of the playing pieces where the grid defines the playing surface boundary. Two of the squares define starting points which correspond to each team, respectively. The group of squares defines a first reserved area for a team, which permits only players from that team to start words in that reserved area. Adjacent to the first reserved area is a second reserved area assigned to the second team, which permits only players from the second team to start words in that area. The boundary line between the first reserved area and the second reserved area represents a bonus bridge dividing line.

A number of the squares carry numerals thereon which define multiplier squares. Forming a word through one of the multiplier squares enables the player to multiply the total score value of the word by the amount of the numeral on the multiplier square. A player is required to form a word of at least five letters in length and to conjoin that word with another word already present on the board. Preferably, two teams of two players each are formed, alternating turns between teams, with players on the same team alternating turns upon their team's turn coming up. When a player cannot form a word of at least five letters or more, that player is allowed to trade up to four letters to that player's team partner face down accompanied by a request for certain desired letters in return for an equal amount of letters. Further, a player may trade up to three letters to an opposing team member if the team on which the player is on has a score less than the opposing team's score; in the event a trade is made to an opposing team member, that opposing team member must accept at least one of the letters.

Further, in the event a player cannot form a word, that player may discard unwanted letters to form a pile to that player's left. The discarded letters are replaced by drawn letters from the common supply. The letters in the pile created by discarded letters must be used by the left adjacent player (on the opposing team) prior to use of the common supply to restore his discarded letters.

Bonus points are awarded if certain goals are met. For example, for joining the two arrays of conjoined words emanating from the two starting points, respectively, additional bonus points will be awarded. Further bonus points are realized if the bridging word crosses the dividing line between the two team reserved areas.

It is therefore an object of the present invention to provide a crossword game board apparatus that provides additional skill and challenge not found in known game board apparatuses.

Another object of the present invention is to provide a crossword game board apparatus that provides interactive team play.

It is a further object of the present invention to provide a crossword game board apparatus that provides for the award of bonus points for achieving unique goals.

It is yet a further object of the present invention to provide a crossword game board apparatus which enhances competitive game play.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Game Board Apparatus

Figure 1:
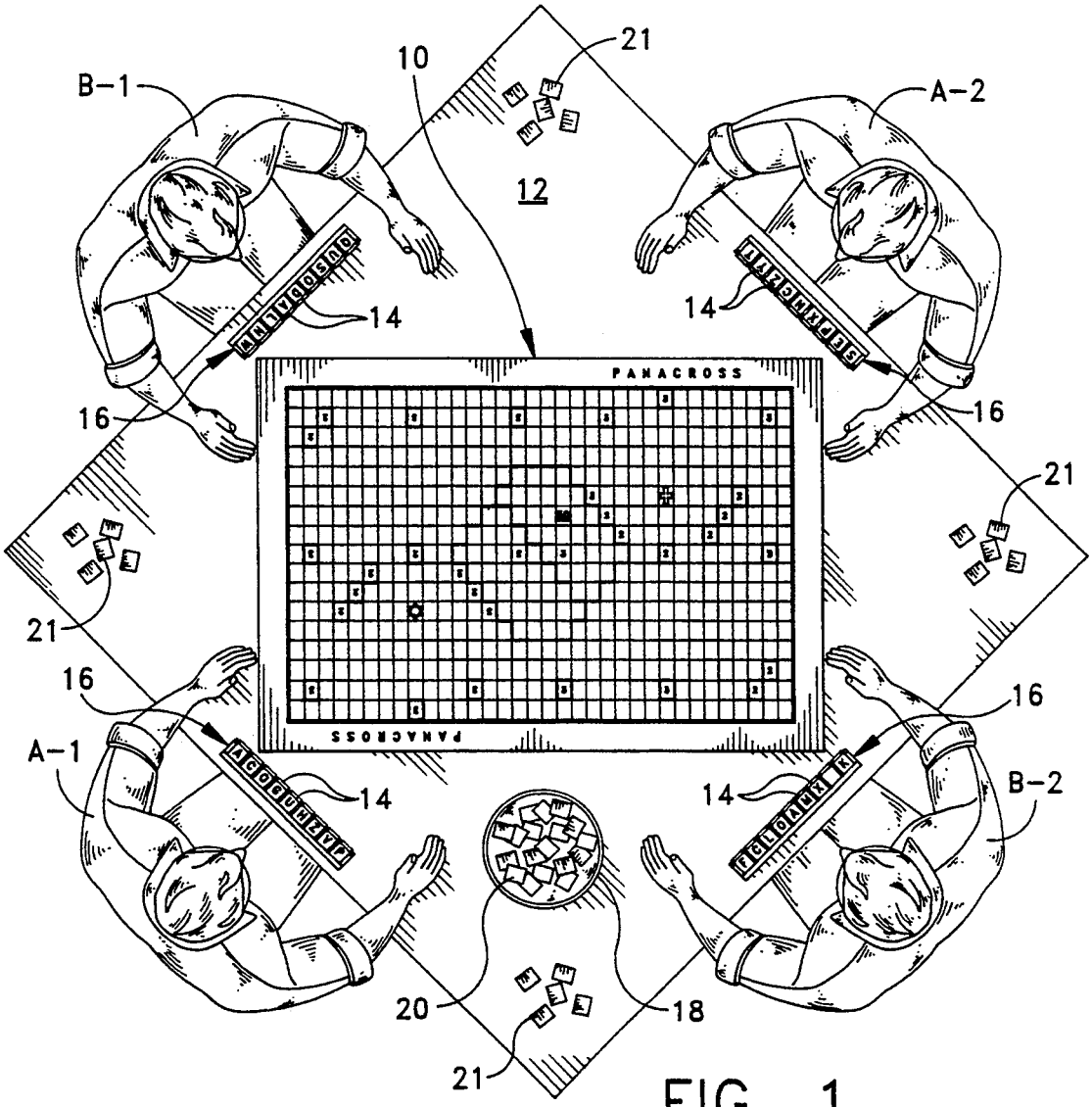
FIG. 1 is a plan view of the crossword game board apparatus of the present invention illustrating the player seating arrangement.

Referring to FIG. 1, a general plan view of the seating arrangement and game board layout of the present invention is shown. A table 12, or other support structure, is shown with each of the four players sitting at each of the four edges. The crossword game board apparatus of the present invention is positioned diagonally across table 12 so that players on the same team sit across from one another. For example, Team A includes players A-1 and A-2 which are seated at the lower left and upper right edges of table 12. As a result, players A-1 and A-2 have different vantage points of the board 10. Team B includes players B-1 and B-2 which are seated at the upper left and lower right edges of table 12. Similarly, players B-1 and B-2 have different vantage points of the board 10 yet also different from players A-1 and A-2 of Team A.

FIG. 1 further shows playing piece holder 16 for each player for holding playing pieces 14 therein. Due to the seating configuration, players on the opposite team can have substantially the same vantage point for viewing board 10 yet still be able to prevent an opposite team member from viewing their respective playing piece letters 14. Also shown is common supply bowl 18 for housing additional letters 20 for subsequent restoral of used letters by the players. Supplemental supply piles 21 are also provided as will be discussed in more detail below.

Figure 2:
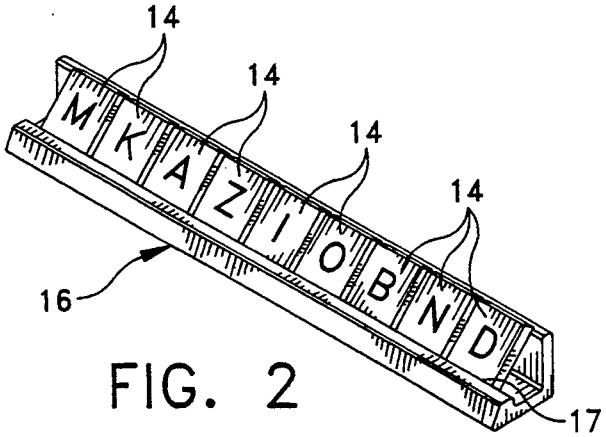
FIG. 2 is a front view of a playing piece's holder in accordance with the present invention.
Figure 3:
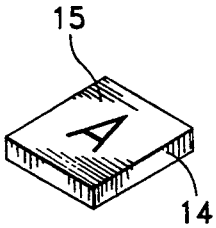
FIG. 3 is a perspective view of a letter playing piece for use with the crossword game board apparatus of the present invention.

FIG. 2 illustrates a detailed view of the playing pieces holder 16 shown in FIG. 1. As can be seen in FIGS. 2 and 3, playing piece letters 14 are planar in configuration and reside in seat 17 of playing piece holder 16. Due to the rack-like configuration of holder 16, the players will be unable to view the letters of other players. FIG. 3 further illustrates one of the playing pieces 14 of the present invention with a letter on the top planar surface 15. The opposing side of playing piece 14 is blank.

Figure 4:
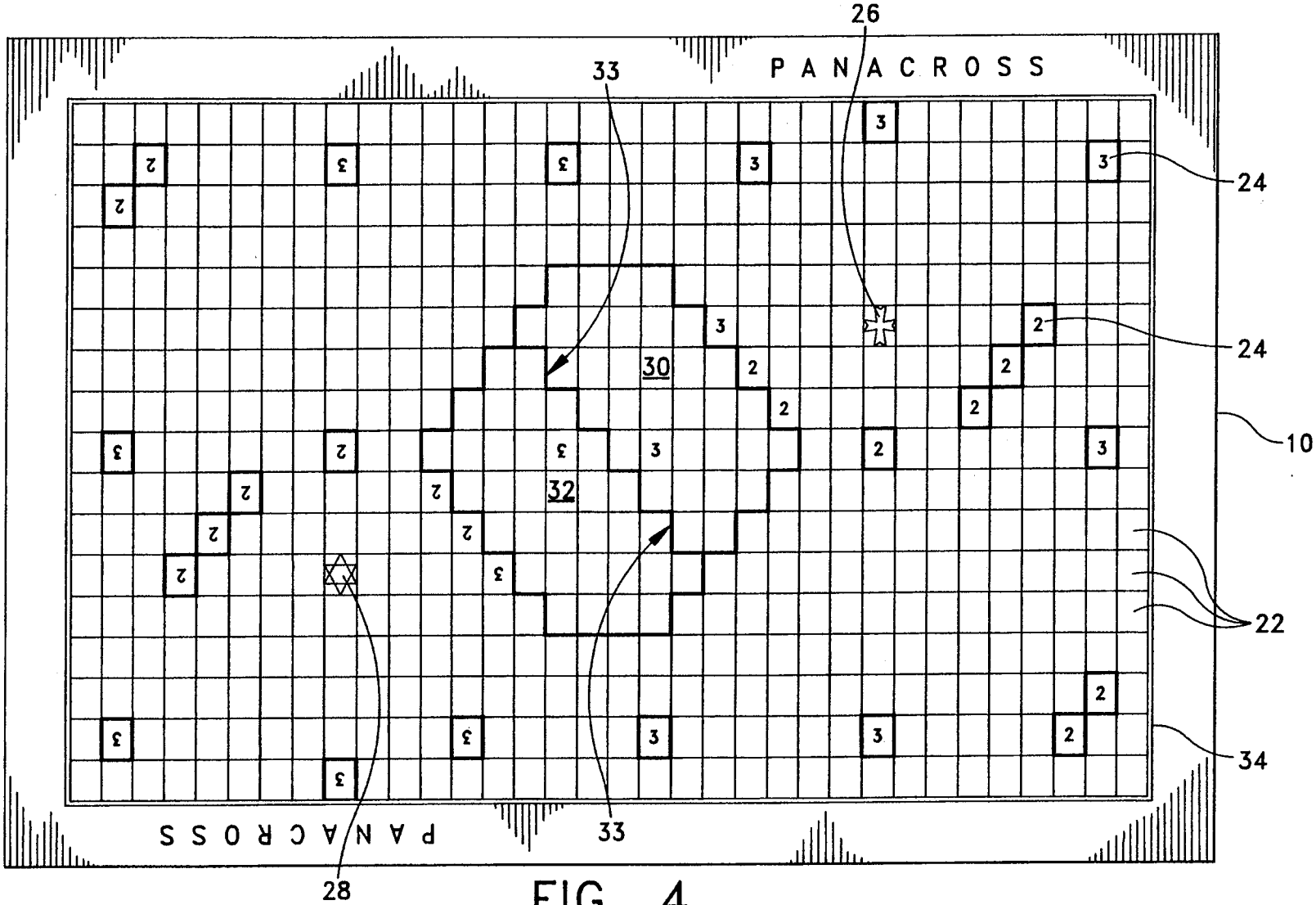
FIG. 4 is a top view of the preferred embodiment of the crossword game board apparatus of the present invention.

Turning now to FIG. 4, the playing board 10 consists of a series of intersecting lines forming substantially equal squares 22 bounded by outer boundary line 34. The playing surface of game board 10 includes two starting spaces 26 and 28 which are assigned to the two competing teams, respectively. Each team must form its first word starting at its respective starting square. After the first word is played by each team from their respective starting squares 26 and 28, either team may then build upon either array which emanates from one of the starting squares 26 or 28. Two arrays of words are built, in crossword fashion, branching out from words which pass through the respective starting spaces.

Game board 10 further includes numerals, such as 2 and 3, on certain squares 22. As a result, squares 24 act as multipliers for the score of the word. If a word is formed through one of the multiplier squares 24, the total score of the word, as will be discussed below, is multiplied by the numeral in multiplier square 24.

In the central portion of game board 10 are two reserved areas 30 and 32. Each of the reserved areas 30 and 32 represents a group of squares 22. The two reserved areas 30 and 32 are adjacent to one another creating a dividing line 33 therebetween which represents a bonus bridge line which will be discussed in more detail below. Prior to the joining of the arrays which emanate from starting points 26 and 28, reserved areas 30 and 32 restrict where players may start new words. Only a player on the team whose starting point is 26 may use a square 22 in reserved area 30 as the first letter of his or her word. Similarly, players on the team whose starting point is square 28 may be the only players who are permitted to start a word in one of the squares 22 in reserved area 32. When the two arrays emanating from squares 26 and 28 are joined together, the prohibition of a player from starting a word in the other team's reserved area will no longer be in effect.

Referring back to FIGS. 1-3, letters 14 can be seen. The entire set of letters, including common supply 20, preferably includes multiples, preferably at least two, of each letter of the alphabet as well a four blank playing pieces 14. Each letter of the alphabet is assigned a scoring value which becomes important when a player places a word on game board 10. When a word is played on the board, the score of each of the letters is totaled up to return a total score for that player's turn. If the word played uses one of the multiplier squares 24, the score of the entire word is multiplied by the multiplier numeral in multiplier square 24. Further, if a word passes through more than one multiplier square 24, then the score of the word is multiplied by the product of the two numerals of the multiplier squares employed.

Preferably, a set of letters includes four blanks to enhance the random nature of the game and to permit it to be customized. A blank may represent any letter and, therefore, its score in a word is the same as that of the letter it is used to represent when forming a word. Further, if a player holds a letter which is presently being represented on the board by a blank, he may then, on his turn, take the blank from the board and replace it with the letter it represents from his own playing pieces holder 16. As a result, that player acquires the blank which may then be used later by that player. It should be understood that the quantity of each letter of the alphabet, their respective scoring value and the number of blank wild card letters in a set may be modified to alter game play.

Game Play

At the beginning of the game, partners are chosen to form two teams of two players each. The playing pieces or letters 14, including blanks, are placed in a container 18, such as a bowl or the like. After a first player is chosen to start the game, each player, preferably, draws nine letters at random from common supply 20 of playing pieces 14 and places them on his or her holder 16. Each player then reviews the letters drawn in an attempt to form a word.

The first player, playing for Team A, for example, which has starting space 26, must build a word through starting space 26 in the upper right hand corner of the board. Typically, this first player places the word so that the letters cover starting space 26 and one of the multiplier squares 24. The word formed by each player must be of five letters or more. If the player is unable to form a word of five letters or more, he must trade letters, as discussed below, and then pass the turn to the next player on the opposing team. In the event a word of five letters or more is successfully made, the partnership, Team A, for example, obtains the score for that particular word built. The player then draws letters from common supply 20 to replace the letters used to previously form the word. When the first player of Team A has finished his turn, the turn then passes to a player on Team B, who is required, in similar fashion to Team A, to form a word through his team's own starting space, starting space 28, with letters oriented in the opposite direction, 180° from the array of Team A. Before a player on side B can build a word anywhere on the board, they must start their own array from starting point 28. Once each team has placed at least one word which employs their respective starting squares 26 and 28, each team may build on the other team's array in addition to their own.

The game play in accordance with the present invention requires players to build words of five letters or more on each turn to create a substantially open structure for each of the arrays emanating from starting points 26 and 28 to ensure a large number of new possible locations for building new words. An exception to the five letter or more requirement is the use of links which will be described in more detail below.

As stated above, if a player on either team or partnership is unable to or prefers not to build a word on his turn, he must trade one or more of his letters. If required, three types of trades may take place. First, a player, on his turn, may trade up to four letters with his partner on his team. The player hands the discarded playing pieces 14 over to his partner face down while simultaneously asking for specific letters in return. For example, a player may request "a, b and c" if he desires that combination and pass, face down, three letters to his partner. The player's partner or teammate, before looking at the face down letters, returns the same number. However, the teammate is not required to return to the player the letters requested even if he has them. In the event a player receives a letter from his partner which he requested as a result of the trade, that player may immediately show that letter and build a word containing the newly acquired letter. As a result of the ability to trade between partners or players on the same team, additional competitiveness is created encouraging teamwork without eliminating a player's own individual playing skill and game play.

As an alternative to trading with one's team member, a player may trade any number of letters by placing them face down in a pile 21 to his left, as shown in FIG. 1, and may draw letters from common supply 20 to replace them. As a result, a pile 21 of letters may accumulate next to each player which have been discarded and traded in by the opponent to his right. These discarded letters in a pile 21 to his right must be picked up by that player prior to drawing from the common supply 20. Therefore, a player will not always have the opportunity to pick fresh letters from common supply bowl 20, he may be required to draw from letters which have been previously discarded by the player to his right. This adds an element of skill and removes some of the random nature of blind drawing from a supply bowl.

A third alternative, if a player cannot form a word, is to trade up to three letters to an opponent on the opposing team. Such a trade option is only available if the player seeking to make the trade is on the team or partnership which has the lower score at the time. If the player's team has a lower score, a trade with an opponent is available and the opponent must accept at least one of the letters. As a result, a trade with an opponent typically has the effect of interfering with an opponent's building of a long word. The ability to trade with a player on an opposing team adds strategy, particularly if it is ascertained that the opposing player has not built a word for a few turns which may indicate that the opposing player is trying to create a long word or a bonus word.

Figure 5:
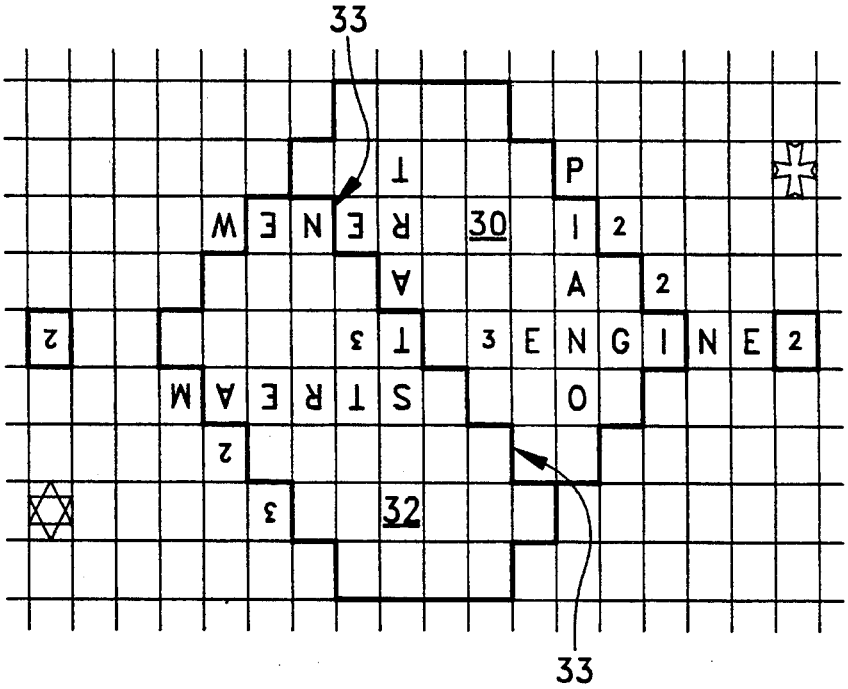
FIG. 5 is a partial plan view of the game board as in FIG. 4 illustrating the two reserved areas.

As stated above with reference to FIG. 4, the center of the board 10 contains two adjacent reserved areas 30 and 32 with a bonus bridge dividing line 33 therebetween. In the event a player joins the two arrays which emanate from starting points 26 and 26 and which also crosses bonus bridge line 33, the team which the player is on will receive bonus points, such as 200 additional points. Turning now to FIG. 5, the game play associated with reserved areas 30 and 32 will be described in greater detail. As shown in FIG. 4, the team which has starting space 26 will also have reserved area 30. Similarly, the team who starts from starting space 28 will have reserved area 32. Referring back to FIG. 5, the team who owns reserved area 30 has formed the word "PIANO" into reserved area 30. Then, the word "ENGINE", which may be formed with its first letter "E" starting in reserved area 30, may be formed only by the team who owns reserved area 30. Similarly, the words "STREAM" and "START" can only be formed by the team who owns reserved area 32. As can be seen, the word "START" has its first letter in reserved area 32 and permissibly extends into the opposing team's reserved area 30. Further, the word "RENEW" may be built from the "R" in "START" only by the team which owns reserved area 30 because the first letter "R" in the word "RENEW" starts in reserved area 30. Further, the example in FIG. 5 also illustrates the ability of a player to build on the array initiated by an opposing team.

It should be noted that the numerals to the left side of board 10 are oriented 180° with respect to those on the right side of board 10. This is intended to guide each team in its orientation of the letters of its first word, and, indeed, the letters of the subsequently conjoined array. Thus, from the viewpoint of a player at one side of the board 10, one of the two arrays will appear upside-down with respect to the other.

Figure 6:
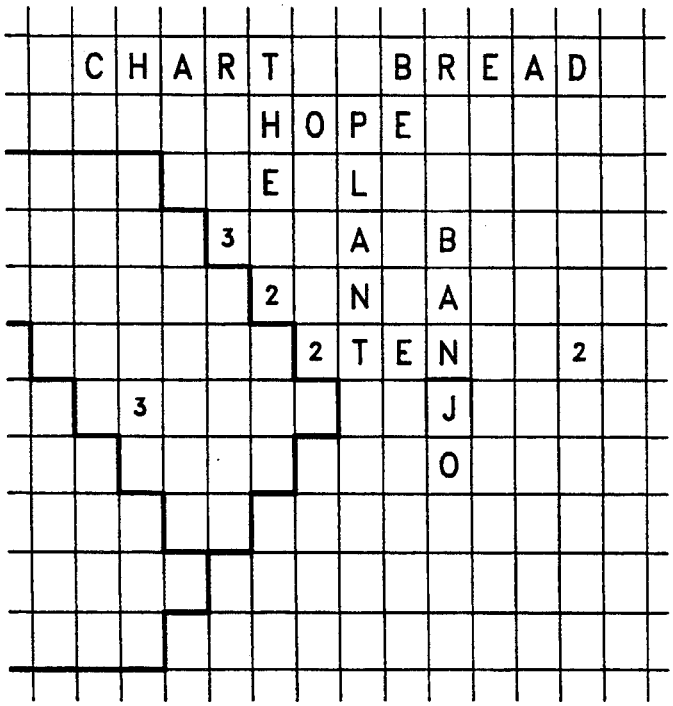
FIG. 6 is a partial plan view of the game board as in FIG. 4 illustrating the use of links.

Turning now to FIG. 6, the use of "links" is shown. As stated above, a player is generally required to form a word of five letters or more or trade. However, a link of two, three, or four letters may be used to link the requisite five letter or more word to the array. In FIG. 6, the word "BANJO" was played first. Next, the word "PLANT" was built onto the array by means of the link "TEN". Next, the current player desired to place the word "CHART", a five letter word, onto the board to satisfy the five letter or more word requirement. Since the word "CHART" is not directly playable on the existing array, the multiple links of "THE" and "HOP" may be played in order to connect the word "CHART" to the existing array. Further, the five letter word "BREAD" may be played with the assistance of link "BE" to further form the link "HOPE".

Figure 7:
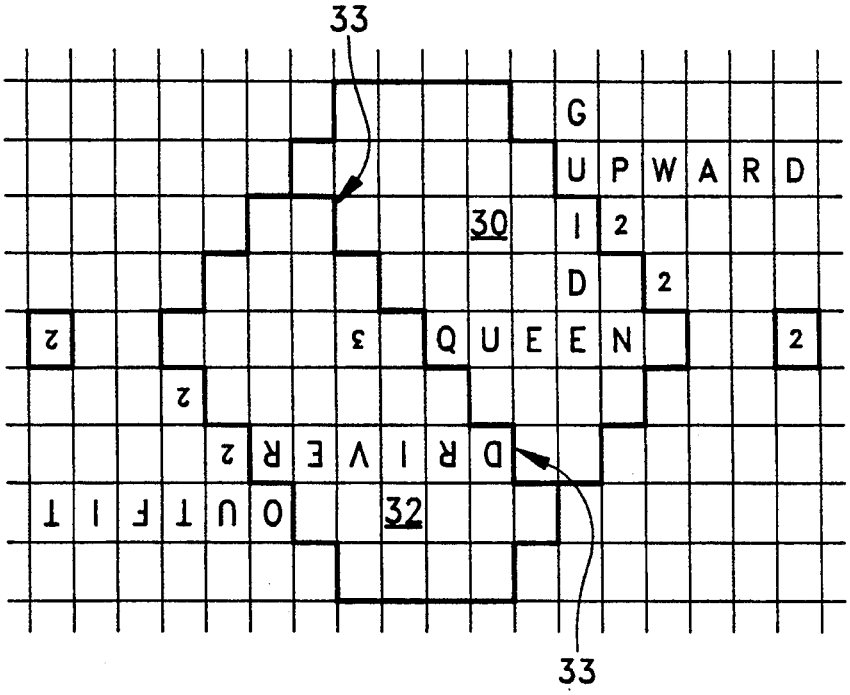
FIG. 7 is a partial plan view of the game board as in FIG. 4 illustrating two arrays prior to joining.
Figure 8:
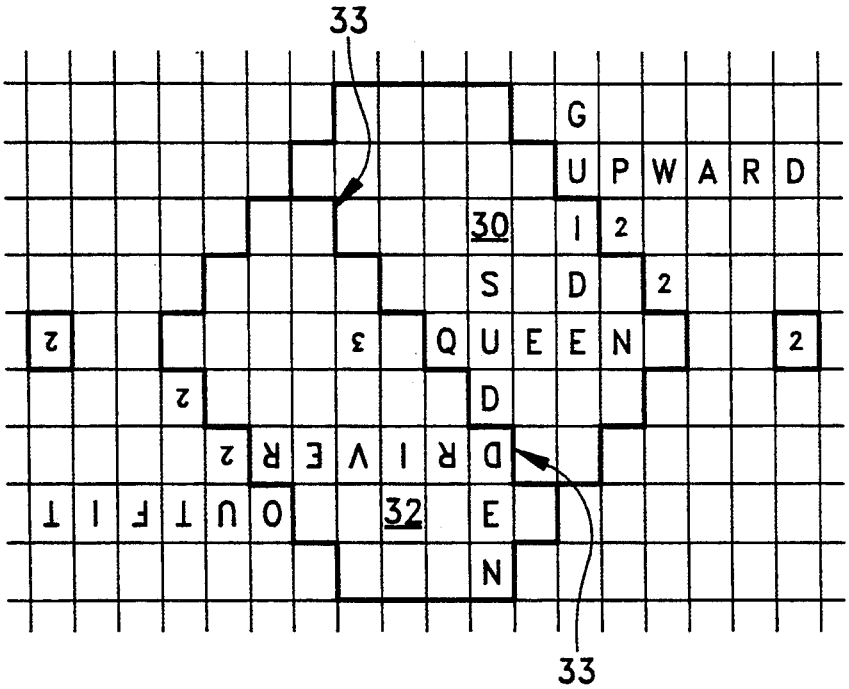
FIG. 8 is a partial plan view of the game board as in FIG. 4 illustrating two arrays after joining.

Means for obtaining bonus points may be achieved when the two arrays emanating from the two starting points are joined. This occurs when the two arrays come so close to each other that a word may be built from array to the other, even though the letters are oriented in opposite directions. As shown in FIG. 7, the two arrays, oriented 180° from one another, have come close to one another to enable a word to be built between them to bridge them together. This bridge will cross over from one array, which appears right-side-up, to a letter in the second array which appears upside-down, although it is the correct letter for the bridge. In FIG. 8, the two arrays, as shown separately in FIG. 7, are now shown joined together by the bridge toward "SUDDEN". A player on either side may build the joined word "SUDDEN" on the array that appears right-side-up. As can be seen, the letters in "SUDDEN" have the same orientation as the letters in the array in the upper right hand corner of the figure which the exception of the "D" in "DRIVER" from the array which is oriented upside-down.

Figure 9:
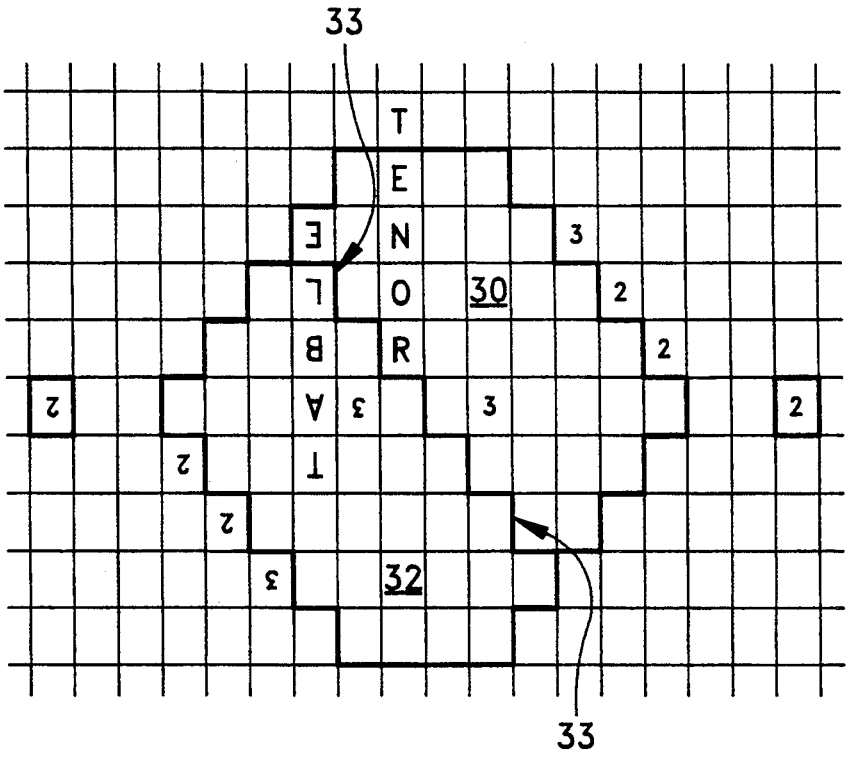
FIG. 9 is a partial plan view of the game board as in FIG. 4 illustrating the possible use of a link prior to bridging the arrays of words.
Figure 10:
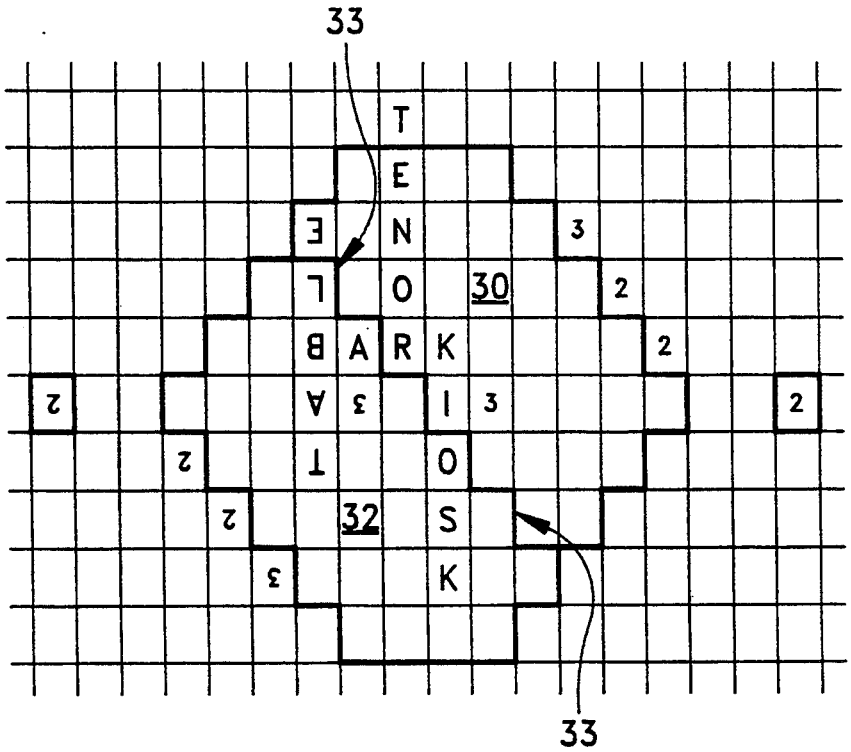
FIG. 10 is a partial plan view of the game board as in FIG. 4 illustrating use of a link as part of a bridge between two arrays after the bridge is formed.

Further, a link may be a part of the bridge between the two arrays. FIGS. 9 and 10 illustrate the joining of two arrays via the use of links. Parts of the arrays, before joining, are shown in FIG. 9. The next player may join the two arrays using the link word "BARK" which then, in turn, allows the formation of "KIOSK" to satisfy the minimum five letter word requirement. Therefore, the word "BARK" may be built on "TENOR" using the "B" in "TABLE." The direction of creating a word is dictated by the letters which have just been played by the current player. Therefore, the word "BARK", with newly placed letters "A" and "K" will require that the word be read from left to right in accordance with the orientation of the newly placed letters.

If any part of a bridging word, including links, crosses bonus bridge line 33, which separates reserved areas 30 and 32 from one another, a score of bonus points, for example 200 points, is received by the partnership building it. If a bridge is built within reserved areas 30 or 32, but not crossing line 33, then bonus score is typically less, such as 150 points. If a bridge word is formed of which no part lies within reserved areas 30 or 32, the bonus score may be set even lower, such as 100 points. The point score award for these bonuses may be modified by the players.

To further enhance the challenge of the game of the present invention, a list of bonus words and their scores may be determined in advance by the players. In the event a player successfully builds a word which appears on the list of bonus words, that player's team will receive an additional score, preferably between 150 and 300 points. It may be desirable to select bonus words to be words that are relatively difficult to form, such as "XYLOPHONE".

The rules of the game to be played with the crossword board game apparatus of the present invention may be modified to make the game easier to play. For example, after the first array has been started by one team, any player may build upon the first array even if the second array has not been started. Further, reserved areas 30 and 32 may be ignored.

Typically, in this modification, the score for joining two arrays is typically 100 points. However, in the event that a second array has not been started at all, a player may build a word onto the sole array through the unoccupied starting space for the unformed array and receive a bonus score of 200 points.

In addition, the minimum five letter word requirement may be relaxed to facilitate game play. Words employing foreign languages, proper names and the like may be allowed. The players may agree that adding "S" at the end of an existing word is permissible to make the word plural. Further, the players may agree that a player may pass his turn as an alternative to the requirement of either building a word or trading letters. In the event a player passes, that player may not trade again, not even with his partner, unless an opponent offers to trade, until he has formed a new word. Also, the requirement that a player select from the pile 21 of letters to his right to replace used letters, may be loosened to allow a player to trade letters by drawing from the common supply 20 rather than from his discard pile. This drawing from the common supply 20 may be exercised on two of the player's turns during the game.

Further, if a player builds a word which is part of a bonus word, that player may reserve the spaces adjacent to the word, so that the bonus word may be played there on a subsequent turn. As a result, no player may place letters in the adjacent spaces which could interfere with the forming of the bonus word. Also, if a player on the opposite side forms the reserved bonus word, the bonus score received by the player is doubled. Further, the player who reserved spaces for a bonus word may subsequently cancel the reserve; however, if an opponent objects, he may not cancel the reserve. Under this rule, a player may build a word of fewer than five letters when reserving space for a bonus word. In such a case, however, that player would not receive a score for the word, unless it were a link to a five-letter word, until he had completed the bonus word. This is the only instance when a turn could be taken by playing a word of fewer than five letters.

Alternatively, the players may adopt a method of scoring in which the numerals have a different significance than described above. In this alternative method of scoring, the numerals are not used to multiply the basic score of the word. When a player builds a word through one of the numerals, that player receives the basic score for the word and extra letters in the number equal to the numeral. For example, if a word is built which covers a "3", that player may draw three extra letters. If a player built a word which covered two of the multiplier squares 24 with numerals "3" thereon, that player would receive nine extra letters. These extra letters, any or all of them, may be picked from the common supply 20 or from the discard pile 21 to the player's right. If, on a subsequent turn, the player trades letters without forming a word, that player retains the extra number of letters. On the other hand, if the player builds a word and is subsequently reduced to fewer than nine letters, the player brings the number of his letters up to nine by drawing in the usual manner. If the player builds a word and still has nine or more letters remaining, he does not draw additional letters. However, if the player again builds a word through a numeral, he will again draw additional letters, as above. The use of this method of scoring encourages the building of bonus words because the players have a greater number of letters available for trading and formation of words. This method also encourages the building of words through numerals and words not necessarily longer than five letters.

It would be appreciated by those skilled in the art that various changes and modifications can be made to the illustrated embodiments without departing from the spirit of the present invention. All such modifications and changes are intended to be covered by the appended claims.

What is claimed is:

1. A board game apparatus for play by two teams of players, comprising:

a plurality of playing pieces each which is planar, a number of said plurality of playing pieces being marked on one side with a single letter of the alphabet with the remainder of said pieces being blank denoting universal use, each playing piece being assigned a scoring value, and rules for playing a game with the apparatus which rules require the initial random allotments of an equal set of playing pieces to each of the players; a number of said playing pieces being a common supply for replacement of discarded letters;

a game board having a flat surface for receiving thereon said playing pieces in the form of words;

a grid of a plurality of essentially equal squares formed of intersecting lines conforming substantially to the configuration of said playing pieces, with said grid defining a boundary of a playing surface of said flat surface;

two of said plurality of equal squares each having different indicia means for defining starting points for each team, respectively;

a plurality of said equal squares having a first indicia means for defining a first reserved area for a first team wherein said first reserved area permits only players of the first team to form words in the first reserved area where the first letter of a word lies in the first reserved area;

a plurality of said equal squares having a second indicia means for defining a second reserved area for a second team wherein said second reserved area permits only players of the second team to form words in the second reserved area where the first letter of a word lies in the second reserved area; said first reserved area and said second reserved area being adjacent to one another forming a bridge dividing line therebetween;

a plurality of said squares carrying numerals thereon defining multiplier squares whereby formation of a word through one of said multiplier squares multiplies the total score value of the word by the amount of the numeral on the multiplier square; and said playing pieces being formed into words of at least five letters and placed on said game board forming conjoined words in crossword format in alternating turns between teams with players on the same team alternating turns upon their team's turn coming up with subsequent restoral of the predetermined equal set of playing pieces; when a player cannot form a word of at least five letters or more, that player is capable of trading up to four letters to that player's team partner face down with a request for certain desired letters in return for an equal amount of letters.

2. The apparatus of claim 1, wherein said game board is foldable cardboard.

3. The apparatus of claim 1, wherein said first reserved area and said second reserved area are adjacent to one another and centrally located within said grid to form a bonus bridge line therebetween; said bonus bridge line being positioned between said starting points.

4. A method of playing a game board apparatus for play by two teams of players, involving the formation of words, comprising the steps of:

providing a plurality of playing pieces each which is planar, a number of said plurality of playing pieces being marked on one side with a single letter of the alphabet with the remainder of said pieces being blank denoting universal use;

assigning each playing piece being assigned a scoring value;

issuing initial random allotments of an equal set of playing pieces to each of the players;

forming playing pieces not issued into a common supply for replacement of discarded letters;

providing a game board having a flat surface for receiving thereon said playing pieces in the form of words;

providing a grid of a plurality of essentially equal squares formed of intersecting lines conforming substantially to the configuration of said playing pieces;

providing indicia means for defining a boundary of a playing surface of said flat surface with said grid;

providing indicia means for defining two of said squares as a first starting point and a second starting point, to correspond to each team, respectively;

providing indicia means for defining a first reserved area of a plurality of adjacent squares for a first team;

permitting only players of the first team to form words in the first reserved area where the first letter of a word lies in the first reserved area;

providing indicia means for defining a second reserved area of a plurality of adjacent squares for a second team;

permitting only players of the second team to form words in the second reserved area where the first letter of a word lies in the second reserved area;

providing said first reserved area and said second reserved area adjacent to one another;

forming a bridge dividing line between said first and second reserved areas;

providing numerals on a plurality of said squares;

defining said squares with numbers thereon as multiplier squares whereby formation of a word through one of said multiplier squares multiplies the total score value of the word by the amount of the numeral on the multiplier square; and forming said letters into words of at least five letters by placing said letters on said game board;

forming conjoined words in crossword format in alternating turns between teams with players on the same team alternating turns upon their team's turn coming up with a first array and second array of conjoined words emanating from said first starting point and said second starting point, respectively;

drawing letters from said common supply to restore a player's letters to the predetermined equal set of playing pieces; and trading a maximum number of four letters to that player's team partner face down with a request for desired letters in return for an equal amount of letters when a player cannot form a word.

5. The method of claim 4, further comprising the step of:

trading a maximum number of three letters to an opposing team member if the team on which the player is on has a score less than the opposing team's score when that player cannot form a word and when that player elects not to trade with a team partner; in the event trading is offered to an opposing team member, that opposing team member must accept at least one of the letters.

6. The method of claim 7, further comprising the steps of:

discarding any number of letters to form a pile to that player's left;

replacing letters discarded with those drawn from said common supply; and requiring a left adjacent player to draw from said pile prior to drawing from said common supply to restore discarded letters.

7. The method of claim 4, further comprising the step of:

providing a game board manufactured of foldable cardboard.

8. The method of claim 4, further comprising the step of:

awarding predetermined bonus points upon a team bridging an array of conjoined words of the first team with an array of conjoined words of the second team.

9. The method of claim 4, further comprising the step of:

orienting said first array 180° from said second array.

10. The method of claim 4, further comprising the step of:

positioning said first reserved area and said second reserved area adjacent to one another;

centrally locating said first reserved area and said second reserved area within said grid;

forming a bonus bridge line between said first reserved area and said second reserved area;

positioning said first reserved area and said second reserved area between said starting points.

11. The method of claim 10, further comprising the step of:

awarding predetermined bonus points upon a team bridging an array of conjoined words of the first team with an array of conjoined words of the second team where the word that forms the bridge crosses said bonus bridge line.

* * * * *